US009340936B2

(12) United States Patent
Vanderlinden

(10) Patent No.: US 9,340,936 B2
(45) Date of Patent: May 17, 2016

(54) UTILITY TYPE SURFACE CLEANING VEHICLE

(71) Applicant: Roger P. Vanderlinden, Burlington (CA)

(72) Inventor: Roger P. Vanderlinden, Burlington (CA)

( * ) Notice: Subject to any disclaimer, the term of this patent is extended or adjusted under 35 U.S.C. 154(b) by 201 days.

(21) Appl. No.: 13/863,377

(22) Filed: Apr. 15, 2013

(65) Prior Publication Data

US 2015/0000071 A1 Jan. 1, 2015

(51) Int. Cl.
*E01H 1/08* (2006.01)

(52) U.S. Cl.
CPC ..... *E01H 1/0845* (2013.01); *E01H 1/0836* (2013.01)

(58) Field of Classification Search
CPC ..... E01H 1/0836; E01H 1/0845
USPC ..... 15/340.1, 340.3
IPC ..... E01H 1/08
See application file for complete search history.

(56) References Cited

U.S. PATENT DOCUMENTS 3,634,904 A * 1/1972 Larsen ..... E01H 1/0845 15/340.1
3,984,893 A * 10/1976 Ashley ..... E01H 1/0836 15/339
5,317,783 A * 6/1994 Williamson ..... A01G 1/125 15/340.1
5,718,017 A * 2/1998 Pavlick ..... B65F 3/0209 15/340.1
6,070,290 A * 6/2000 Schwarze ..... A01B 45/00 15/340.1
6,263,540 B1 * 7/2001 Vanderlinden ..... E01H 1/0872 15/340.2
6,308,375 B1 * 10/2001 Whitney ..... A01G 1/125 15/340.1
2004/0045122 A1 * 3/2004 Paterson ..... E01H 1/108 15/340.1
2006/0236498 A1 * 10/2006 Nuhn ..... A01K 1/0103 15/340.1

* cited by examiner

*Primary Examiner* — David Redding

(57) ABSTRACT

A utility type surface cleaning vehicle comprises a unitary frame utility type tractor defining a longitudinal axis and having front and back ends, left and right driven rear wheels, at least one steerable front wheel and a trailing unit connecting mechanism. A debris hopper is removably connectable in trailing relation to the utility type tractor via the trailing unit connecting mechanism. A pick-up head is operatively mountable on the unitary frame utility type tractor on the unitary frame utility type tractor forwardly of the rear wheels, and has a debris outlet. An air and debris transfer duct has an inlet connected in debris receiving relation to the debris outlet of the pick-up head and an outlet connected in debris depositing relation to the debris hopper. The air and debris transfer duct extends rearwardly from the pick-up head beneath the rear axle of the unitary frame utility type tractor.

28 Claims, 7 Drawing Sheets

UTILITY TYPE SURFACE CLEANING VEHICLE

RELATED APPLICATIONS

This application is a non-provisional application claiming priority from U.S. Provisional Patent Application Ser. No. 61/624,373 filed on Apr. 15, 2012, which is herein incorporated by reference.

FIELD OF THE INVENTION

The present invention relates to utility type surface cleaning vehicles, and more particularly to a debris pick-up head for a tractor, and specifically to a non-clogging debris pick-up head for a tractor.

BACKGROUND OF THE INVENTION

It is known to use conventional unitary frame utility type tractors in conjunction with debris pick-up heads in order to produce utility type surface cleaning vehicles, such as a street sweeping vehicle, or the like. The many advantages of such utility type surface cleaning vehicles are well known.

Conventional unitary frame tractors have large rear tires inherent to their design and often necessary to achieve desired ground clearance. This creates an issue for maintaining a proper relationship between the gutter broom's deposited swept path and the pickup head. To achieve this, the pickup head must extend further ahead to open up in front of the rear tractor tires. Increasing the pickup head surface area to achieve this is not desirable as it would allow for a decrease in negative pressure. Instead, the duct that connects the pick-up head to the debris hopper would need to be extended in length to cover the larger distance.

Additionally, conventional straight frame tractors can turn within a tighter radius than any conventional truck unit, thus creating a further challenge for ensuring proper relationship is maintained between the pickup head and gutter broom deposited path of material at all times. Often, the front of the unit turns almost sideways causing the pick-up head to miss the debris path laid out by the gutter broom. To avoid this, the front of the pick-up head must be positioned as close as possible to the gutter brooms.

Another issue arising with newer, more compact, unitary frame tractors is the fact that there is virtually no room to run a suction duct over the axle between the inside of the rear tire and tractor frame. This requires the suction duct to come under the axle in the rear further increasing the distance the duct needs to travel from the pickup head to the debris hopper.

There are a couple of significant problems with the increased length of the suction duct. Firstly, when the suction duct requires curves to extend over the axle and enter the hopper where debris can readily clog the duct. This is highly undesirable due to the amount of work involved to remove the clogged debris, and also due to the "down time" that is experienced. Mud and other wet material have a tendency to adhere to the walls of the duct causing further clogging.

Secondly, the increased length of the suction duct causes a decrease in suction power as the material has to travel further to reach the debris hopper. This allows for a drop off in air speed, which can cause material to settle, further contributing to the clogging issue. More suction power is required to deal with the longer distance as well as the resistance created against the outer walls of the duct. It is highly desirable for a suction duct to be in direct in-line connection with the debris hopper for maximum suction power.

It is an object of the present invention to provide a utility type surface cleaning vehicles that use conventional unitary frame utility type tractors for motive power, wherein the pick-up is positioned so as to ensure the pick-up head digests path of debris laid out by gutter broom in tightest turn.

It is another object of the present invention to provide a utility type surface cleaning vehicles that use conventional unitary frame utility type tractors for motive power, wherein debris does not readily clog the duct that connects the pick-up head to the debris hopper.

It is another object of the present invention to provide a unitary type surface cleaning vehicle that uses conventional unitary frame utility type tractors for motive power, wherein suction power is not decreased with the suction duct.

It is another object of the present invention to provide a unitary type surface cleaning vehicle that uses conventional unitary frame utility type tractors for motive power, wherein the pickup head is extended to maintain proper relationship with the gutter brooms so that there is no missed debris laden swept path.

It is another object of the present invention to provide a unitary type surface cleaning vehicle that uses conventional unitary frame utility type tractors for motive power, wherein the pickup head is extended while maintaining the suction duct length from pickup head outlet to debris hopper as short as possible.

It is another object of the present invention to provide a unitary type surface cleaning vehicle that uses conventional unitary frame utility type tractors for motive power, wherein the pickup head extended longitudinally in the direction of travel without impacting its negative pressure.

It is another object of the present invention to provide a unitary type surface cleaning vehicle that uses conventional unitary frame utility type tractors for motive power, wherein the pickup head is extended allowing for the ground to assist in delivering the material back to the pickup head suction outlet.

It is another object of the present invention to provide a unitary type surface cleaning vehicle that uses conventional unitary frame utility type tractors for motive power, wherein the pick-up head is elongated along the surface allowing for material to move within the pick-up head towards the rear suction duct relative to the direction of travel of the tractor.

It is another object of the present invention to provide a unitary type surface cleaning vehicle that uses conventional unitary frame utility type tractors for motive power, wherein the pick-up head maximizes the ground clearance under the tractor when in transport mode.

SUMMARY OF THE INVENTION

In accordance with one aspect of the present invention there is disclosed a novel utility type surface cleaning vehicle comprising a unitary frame utility type tractor defining a longitudinal axis and having a front end and a back end, left and right driven rear wheels and at least one steerable front wheel and a trailing unit connecting mechanism; a debris hopper removably connectable in trailing relation to the utility type tractor via the trailing unit connecting mechanism; a pick-up head operatively mountable on the unitary frame utility type tractor on the unitary frame utility type tractor forwardly of the rear wheels, and having a debris outlet; and an air and debris transfer duct having an inlet connected in debris receiving relation to the debris outlet of the pick-up head and an outlet connected in debris depositing relation to the debris hopper; wherein the air and debris transfer duct extends rearwardly from the pick-up head beneath the rear axle of the unitary frame utility type tractor.

In accordance with another aspect of the present invention there is disclosed a novel debris removal and transfer apparatus for use mounted on a unitary frame utility type tractor defining a longitudinal axis and having a front end and a back end, left and right driven rear wheels and at least one steerable front wheel and a trailing unit connecting mechanism, the debris removal and transfer apparatus comprising a debris hopper removably connectable in trailing relation to the utility type tractor via the trailing unit connecting mechanism; a pick-up head operatively mountable on the unitary frame utility type tractor on the unitary frame utility type tractor forwardly of the rear wheels, and having a debris outlet; and, an air and debris transfer duct having an inlet connected in debris receiving relation to the debris outlet of the pick-up head and an outlet connectable in debris depositing relation to a debris hopper; wherein the air and debris transfer duct extends rearwardly from the pick-up head beneath the rear axle of the unitary frame utility type tractor.

In accordance with yet another aspect of the present invention there is disclosed a novel debris removal and transfer system for use mounted on a unitary frame utility type tractor defining a longitudinal axis and having a front end and a back end, left and right driven rear wheels and at least one steerable front wheel and a trailing unit connecting mechanism, the debris removal and transfer apparatus comprising a debris hopper removably connectable in trailing relation to the utility type tractor via the trailing unit connecting mechanism; a pick-up head operatively mountable on the unitary frame utility type tractor on the unitary frame utility type tractor forwardly of the rear wheels, and having a debris outlet; and an air and debris transfer duct having an inlet connected in debris receiving relation to the debris outlet of the pick-up head and an outlet connected in debris depositing relation to the debris hopper; wherein the air and debris transfer duct extends rearwardly from the pick-up head beneath the rear axle of the unitary frame utility type tractor.

In accordance with yet another aspect of the present invention there is disclosed a novel utility type surface cleaning vehicle comprising a unitary frame utility type tractor defining a longitudinal axis and having a front end and a back end, left and right driven rear wheels and at least one steerable front wheel and a trailing unit connecting mechanism; a debris hopper removably connectable in trailing relation to the utility type tractor via the trailing unit connecting mechanism; a pick-up head operatively mountable on the unitary frame utility type tractor, wherein the pick-up head has a housing having a wide front portion and a narrow rear portion, and a debris outlet in the narrow rear portion; wherein the narrow rear portion of the housing of the pick-up head extends rearwardly beneath the rear axle of the unitary frame utility type tractor; and an air and debris transfer duct having an inlet connected in debris receiving relation to the debris outlet of the pick-up head and an outlet connected in debris depositing relation to the debris hopper.

In accordance with yet another aspect of the present invention there is disclosed a novel debris removal and transfer apparatus for use mounted on a unitary frame utility type tractor defining a longitudinal axis and having a front end and a back end, left and right driven rear wheels and at least one steerable front wheel and a trailing unit connecting mechanism, the debris removal and transfer apparatus comprising a debris hopper removably connectable in trailing relation to the utility type tractor via the trailing unit connecting mechanism; a pick-up head operatively mountable on the unitary frame utility type tractor, wherein the pick-up head has a housing having a wide front portion and a narrow rear portion, and a debris outlet in the narrow rear portion; wherein the narrow rear portion of the housing of the pick-up head extends rearwardly beneath the rear axle of the unitary frame utility type tractor; and an air and debris transfer duct having an inlet connected in debris receiving relation to the debris outlet of the pick-up head and an outlet connected in debris depositing relation to the debris hopper.

In accordance with yet another aspect of the present invention there is disclosed a novel debris removal and transfer system for use mounted on a unitary frame utility type tractor defining a longitudinal axis and having a front end and a back end, left and right driven rear wheels and at least one steerable front wheel and a trailing unit connecting mechanism, the debris removal and transfer apparatus comprising a debris hopper removably connectable in trailing relation to the utility type tractor via the trailing unit connecting mechanism; a pick-up head operatively mountable on the unitary frame utility type tractor, wherein the pick-up head has a housing having a wide front portion and a narrow rear portion, and a debris outlet in the narrow rear portion; wherein the narrow rear portion of the housing of the pick-up head extends rearwardly beneath the rear axle of the unitary frame utility type tractor; and an air and debris transfer duct having an inlet connected in debris receiving relation to the debris outlet of the pick-up head and an outlet connected in debris depositing relation to the debris hopper.

In accordance with yet another aspect of the present invention there is disclosed a novel utility type surface cleaning vehicle comprises a unitary frame utility type tractor defining a longitudinal axis and having a front end and a back end, a first rear wheel and a second rear wheel, and at least one steerable front wheel, and a trailing unit connecting mechanism. A debris hopper is removably connectable in trailing relation to the utility type tractor via the trailing unit connecting mechanism. A pick-up head extends between a front end and back end, and adjacent the front end extending between a first side and a second side, and has a debris outlet. The pick-up head is operatively mountable on the unitary frame utility type tractor between the first rear wheel and the second rear wheel and such that the front end of the pick-up head is disposed forwardly of the front of the each of first rear wheel and the second rear wheel, and such that the first side edge of the pick-up head is disposed laterally outwardly beyond the inner edge of the first rear wheel and the second side edge of the pick-up head is disposed laterally outwardly beyond the inner edge of the second rear wheel. A first gutter broom is disposed immediately forwardly of the first rear wheel and a second gutter broom disposed immediately forwardly of the second rear wheel. The first gutter broom and the second gutter broom are substantially adjacent each other with a lateral gap therebetween, and wherein the lateral gap is smaller than the width of the front end of the pick-up head.

In accordance with yet another aspect of the present invention there is disclosed a novel utility type surface cleaning vehicle comprises a unitary frame utility type tractor defining a longitudinal axis and having a front end and a back end, a first rear wheel and a second rear wheel, a first steerable front wheel and a second steerable front wheel, and a trailing unit connecting mechanism. A debris hopper is removably connectable in trailing relation to the utility type tractor via the trailing unit connecting mechanism. A longitudinal gap is at the bottom of the unitary frame utility type tractor and having a length defined between the first front wheel and the first rear wheel. A pick-up head extends between a front end and back end, and adjacent the front end extending between a first side and a second side, and has a debris outlet. The pick-up head is operatively mountable on the unitary frame utility type tractor between the first rear wheel and the second rear wheel and such that the front end of the pick-up head is disposed forwardly of the front of the each of first rear wheel and the second rear wheel, and such that the first side edge of the pick-up head is disposed laterally outwardly beyond the inner edge of the first rear wheel and the second side edge of the pick-up head is disposed laterally outwardly beyond the inner edge of the second rear wheel. A first gutter broom has an overall diameter and is disposed at least partially between the first front wheel and the first rear wheel. The overall diameter of the first gutter broom is at least eighty percent of the longitudinal gap.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described herein below.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently embodiment of the invention will now be illustrated by way of example. It is expressly understood, however, that the drawings are for the purpose of illustration and description only, and are not intended as a definition of the limits of the invention. In the accompanying drawings.

DETAILED DESCRIPTION OF A EMBODIMENT

Figure 1:
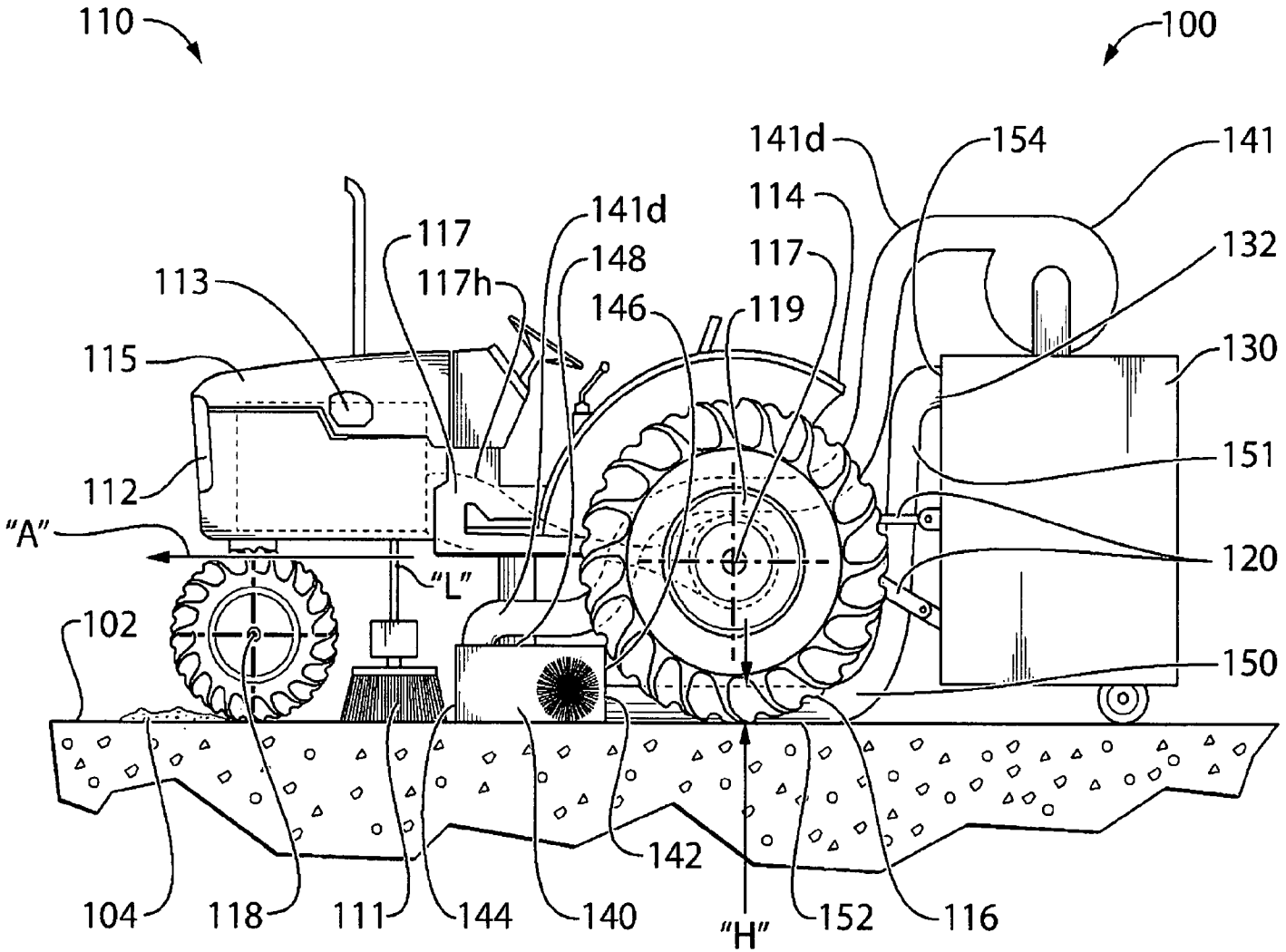
FIG. 1 is a side elevational view of the first embodiment of the utility type surface cleaning vehicle according to the present invention.
Figure 2:
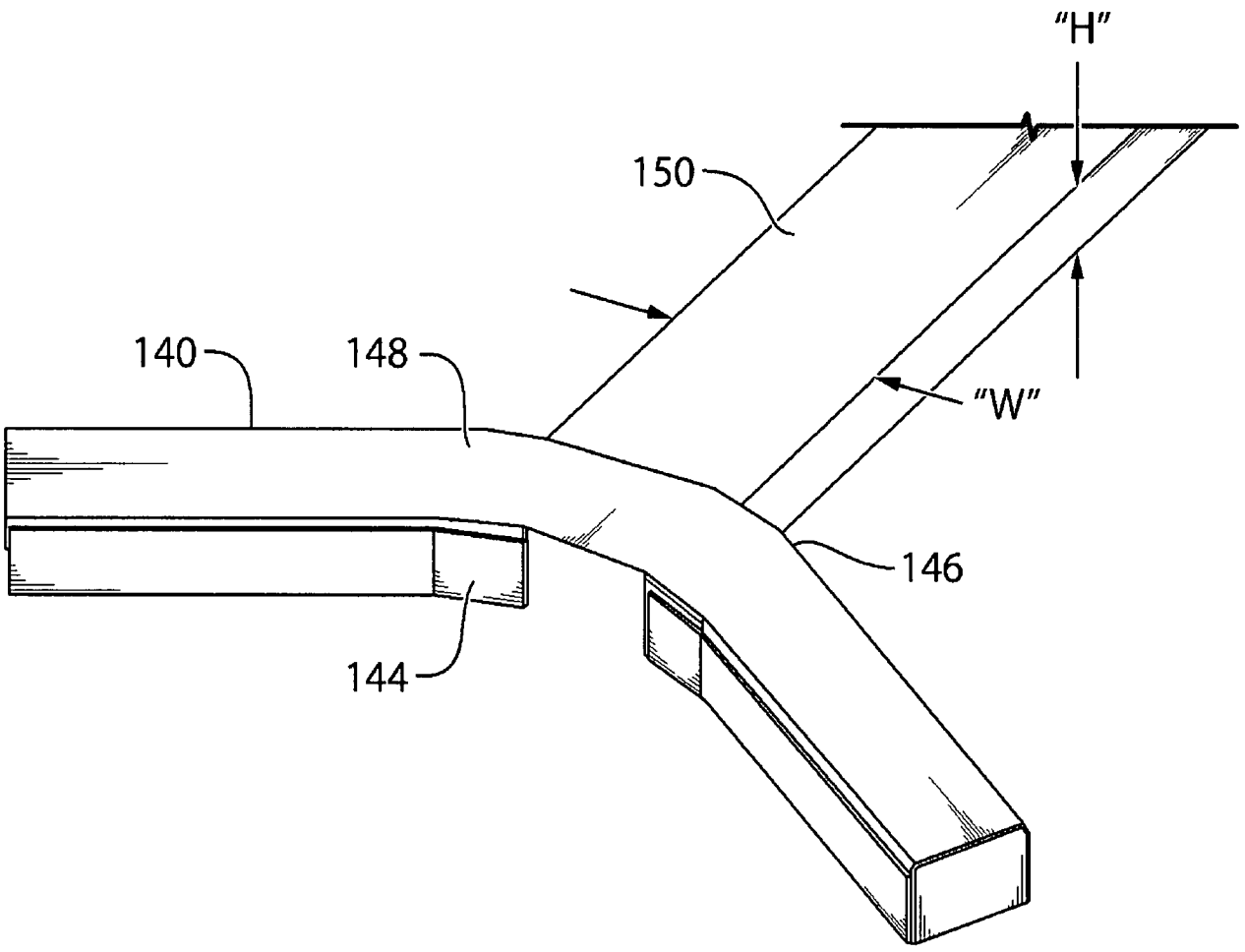
FIG. 2 is a perspective view from the top of the first embodiment of the utility type surface cleaning vehicle of FIG. 1.
Figure 3:
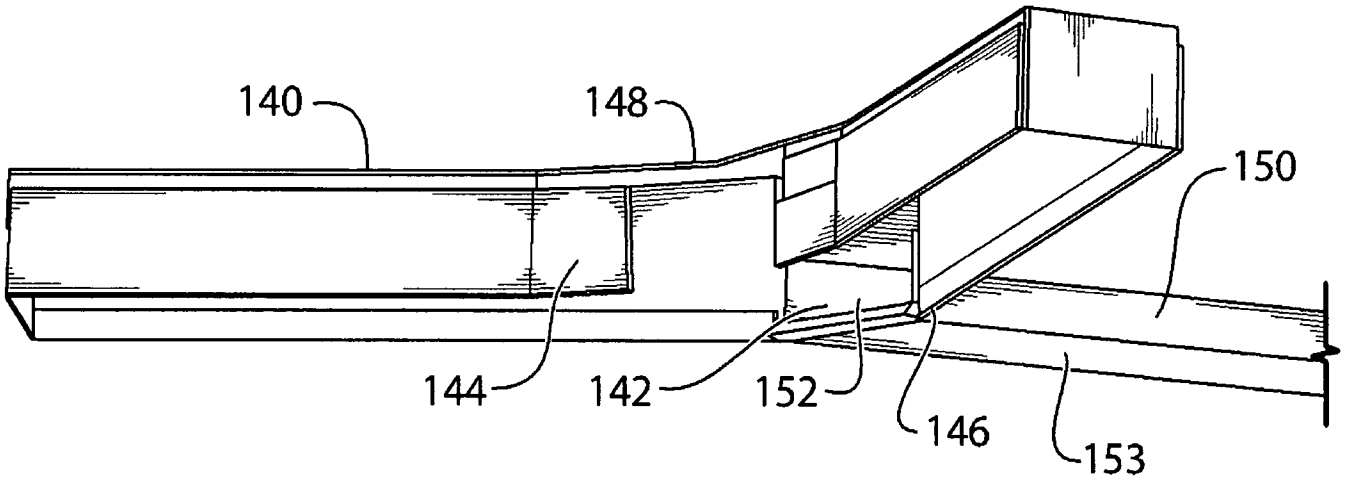
FIG. 3 is a perspective view from the bottom of the first embodiment of the utility type surface cleaning vehicle of FIG. 1.
Figure 4:
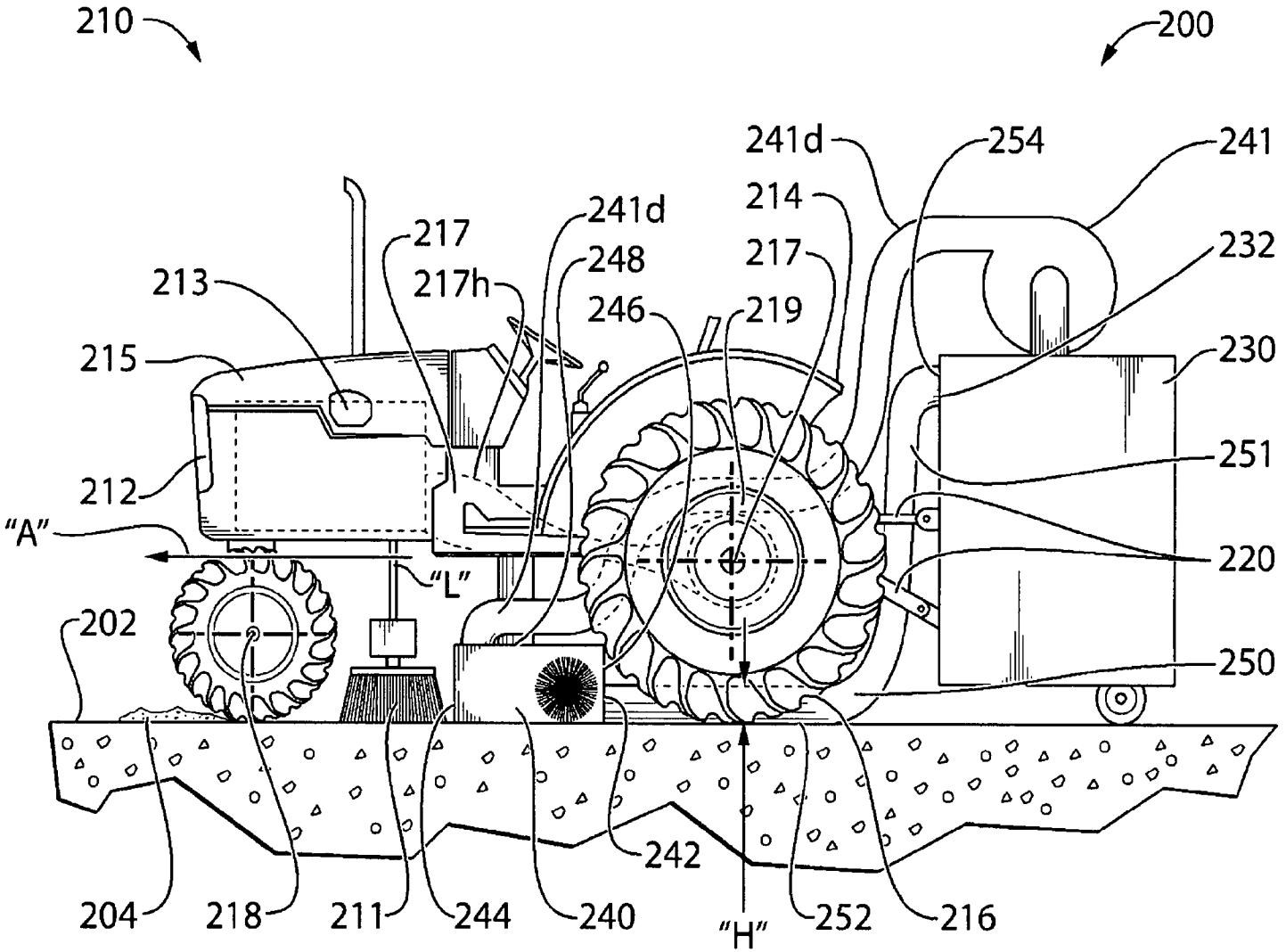
FIG. 4 is a side elevational view of the second embodiment of the utility type surface cleaning vehicle according to the present invention.
Figure 5:
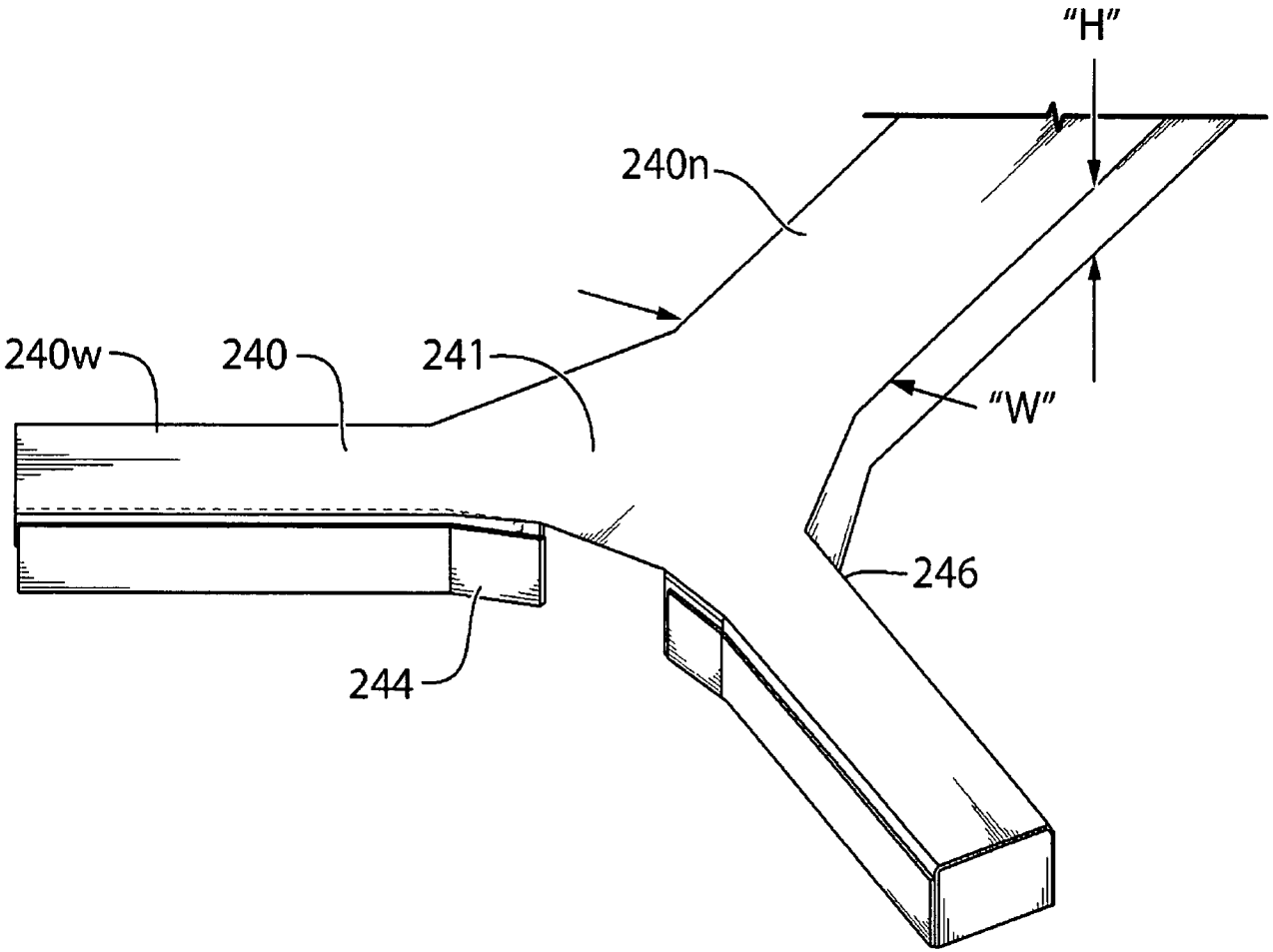
FIG. 5 is a perspective view from the top of the second embodiment of the utility type surface cleaning vehicle of FIG. 4; and, FIG. 6 is a perspective view from the bottom of the second embodiment of the utility type surface cleaning vehicle of FIG. 4.
Figure 6:
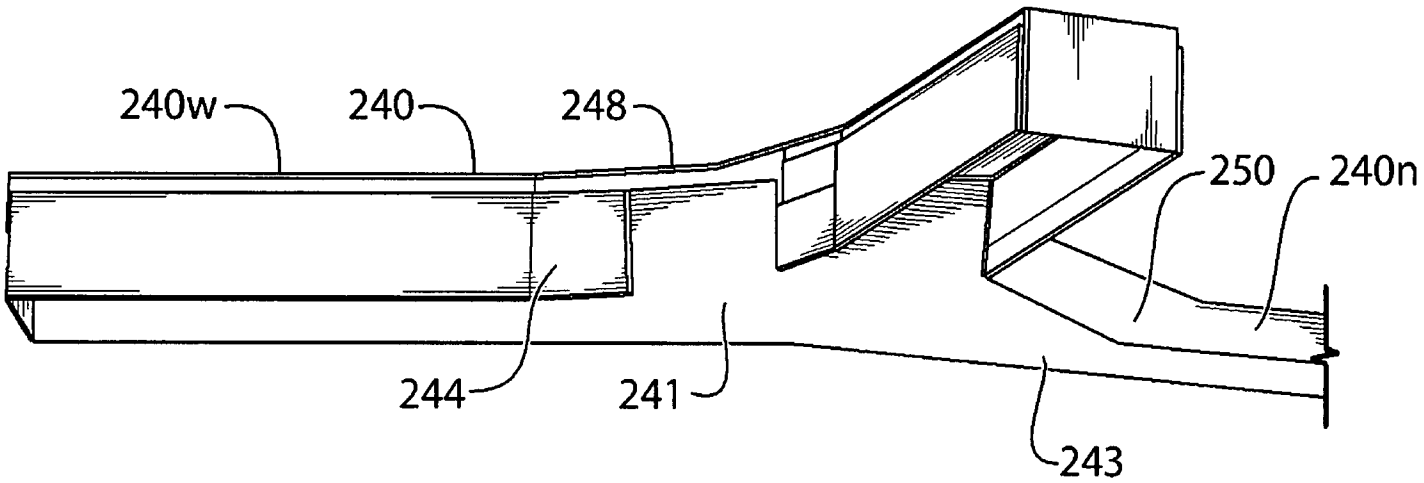

Referring to FIGS. 1 through 6 of the drawings, it will be noted that FIGS. 1 through 3 illustrate a first embodiment of the utility type surface cleaning vehicle according to the present invention, and FIGS. 4 through 6 illustrate a second embodiment of the utility type surface cleaning vehicle according to the present invention.

Reference will now be made to FIGS. 1 through 3, which show a first embodiment of the utility type surface cleaning vehicle of the present invention, as indicated by general reference numeral 100. The utility type surface cleaning vehicle 100 comprises a unitary frame utility type tractor 110 defining a longitudinal axis "L" and having a front end 112 and a back end 114, left and right driven rear wheels 116 and at least one steerable front wheel 118 and a trailing unit connecting mechanism 120.

An internal combustion engine 113 that produces about sixty-five to seventy horsepower is mounted within an external engine housing 115 forming part of the unitary frame utility type tractor 110. A manual transmission 117 is connected in driven relation to the internal combustion engine 113, with the robust housing 117*h* of the manual transmission 117 forming part of the unitary frame utility type tractor 110. A rear differential 119 is connected in driven relation to the manual transmission 117 and also forms part of the unitary frame utility type tractor 110.

A debris hopper 130 has a debris inlet 132, connectable in trailing relation to the utility type tractor via the trailing unit connecting mechanism 120. A pick-up head 140 is operatively mountable on the unitary frame utility type tractor 110 forwardly of the rear wheels 116. The pick-up head 140 is selectively raisable and lowerable between a lower surface-engaging position, and a raised damage-precluding position. There is a debris outlet 142 located in the pick-up head 140, preferably disposed at the back end 114 of the pick-up head 140.

The pick-up head 140 is operatively mountable on the unitary frame utility type tractor 110 in vertically free-moving relation so as to accommodate vertical variations in a surface being cleaned 102.

The pick-up head 140 has a front wall 144, a back wall 146, and a top surface 148. Preferably, the back wall 146 is sloped inwardly and rearwardly to the debris outlet 142, to thereby deflect debris 104 on the surface being cleaned 102 to the debris outlet 142 as the utility type surface cleaning vehicle 100 travels forwardy, as indicated by arrow "A".

In the embodiment, as illustrated, the pick-up head 140 comprises a suctioning type pick-up head, preferably a recirculating air type pick-up head, having a main air fan 141 connected to the pick-up head 140 via an air feed duct 141*d*. Further, as can be readily seen in the Figures, the utility type surface cleaning vehicle 100 further comprises at least one gutter broom 111 mounted on the utility type tractor forwardly of the pick-up head 140 and rearwardly of the at least one steerable front wheel 118.

An air and debris transfer duct 150 has an inlet 152 connected in debris receiving relation to the debris outlet 142 of the pick-up head 140 and an outlet 154 connected in debris depositing relation to the inlet 132 of the debris hopper 130. Preferably, the air and debris transfer duct 150 is substantially rigid, made from a suitable metal material, or any other suitable material. In the embodiment, as illustrated, the air and debris transfer duct 150 extends rearwardly from the pick-up head 140 beneath the rear axle assembly 117 of the unitary frame utility type tractor 110. A rear section 151 of the air and debris transfer duct 150, which extends from the area adjacent the and of the tractor to the debris inlet 132 of the debris hopper 130, is generally straight.

The air and debris transfer duct 150 is mounted on the unitary frame utility type tractor 110 in vertically free-moving relation so as to accommodate vertical variations in a surface being cleaned 102. Further, the pick-up head 140 and the air and debris transfer duct 150 are connected together one to the other in vertically offsetable relation. In other words, one or both of the pick-up head 140 and the air and debris transfer duct 150 can be moved vertically with respect to the other in order to adjust the effective cross-sectional area with respect to the surface being cleaned. A suitably flexibly connecting member, or the like, which is not specifically shown, can be used to span between the pick-up head 140 and the air and debris transfer duct 150 in sealed relation one to the other such that a flow of air does not pass between the pick-up head 140 and the air and debris transfer duct 150.

The air and debris transfer duct 150 has a maximum width "W" and a maximum height "H". Preferably, the maximum width "W" is substantially greater than the maximum height "H". Even more preferably, the ratio of the maximum width "W" to the maximum height "H" is at least 10:1, and the air and debris transfer duct 150 is substantially rectangular in cross-section.

As can be readily seen in FIG. 3, the air and debris transfer duct 150 has a bottom opening 153 along its bottom area to thereby be open to a surface being cleaned. The bottom opening 153 is a very significant aspect of the present invention. In the prior art, large debris, such as small branches or the like, would become lodged in a prior art duct that is closed around its entire periphery. With the present invention, any large debris that might otherwise become lodged in a prior art duct that is closed around its entire periphery, would not become stuck in the open-bottom air and debris transfer duct 150. Large debris, such as small branches or the like, are merely "ridden over" by the open-bottom air and debris transfer duct 150, thereby precluding debris from becoming stuck. The bottom opening 153 of the air and debris transfer duct 150 is generally defined along its lateral perimeter by a first bottom edge 153*a* and a second bottom edge 153*b*. At least one sealing member 157 is disposed along the first and second bottom edges 153*a*,153*b*, such that in use, the at least one sealing member 157 is disposed in sealing contact with a surface being cleaned.

The pick-up head 140 extends laterally between a first side edge 141*a* and a second side edge 141*b*. The first side edge 141*a* and the second side edge 141*b* are disposed forwardly of the first and second rear wheels 116 of the tractor 110. Further, the first side edge 141*a* of the pick-up head 140 is disposed laterally outwardly beyond the inner edge of the first rear wheel and the second side edge 141*b* of the pick-up head is disposed laterally outwardly beyond the inner edge of the second rear wheel.

The pick-up head also includes pick-up head side walls 143*s* that are connected to an upper pick-up head portion 143*u* for movement between a lowered in-use position and a raised position. The pick-up head side walls are connected to the upper pick-up head portion by hinges 143*h*. There are also hinge covers 143*hc* to secured over the hinges 143*h*.

The air and debris transfer duct 141*d* includes duct side walls 141*s* that are connected to an upper duct portion 141*u* for movement between a lowered in-use position and a raised position. The duct side walls 141*s* are connected to the upper duct portion 141*u* by hinges 141*h*. There are also hinge covers 141*hc* secured over the hinges 141*h*.

Reference will now be made to FIGS. 4 through 6, which show a second embodiment of the utility type surface cleaning vehicle of the present invention, as indicated by general reference numeral 200. The utility type surface cleaning vehicle 200 comprises a unitary frame utility type tractor 210 defining a longitudinal axis "L" and having a front end 212 and a back end 214, left and right driven rear wheels 216 and at least one steerable front wheel 218 and a trailing unit connecting mechanism 220.

An internal combustion engine 213 that produces about sixty-five to seventy horsepower is mounted within an external engine housing 215 forming part of the unitary frame utility type tractor 210. A manual transmission 217 is connected in driven relation to the internal combustion engine 213, with the robust housing 217*h* of the manual transmission 217 forming part of the unitary frame utility type tractor 210. A rear differential 219 is connected in driven relation to the manual transmission 217 and also forms part of the unitary frame utility type tractor 210.

A debris hopper 230 has a debris inlet 232, connectable in trailing relation to the utility type tractor via the trailing unit connecting mechanism 220. A pick-up head 240 is operatively mountable on the unitary frame utility type tractor 210 forwardly of the rear wheels 216. The pick-up head 240 is selectively raisable and lowerable between a lower surface-engaging position, and a raised damage-precluding position.

The pick-up head 240 is operatively mountable on the unitary frame utility type tractor 210, in vertically free-moving relation so as to accommodate vertical variations in a surface being cleaned 202.

In the second embodiment, as illustrated, the pick-up head 240 comprises a suctioning type pick-up head, preferably a recirculating air type pick-up head, having a main air fan 141 connected to the pick-up head 140 via an air feed duct 141*d*. Further, as can be readily seen in the Figures, the utility type surface cleaning vehicle 200 further comprises at least one gutter broom 211 mounted on the utility type tractor forwardly of the pick-up head 240 and rearwardly of the at least one steerable front wheel 218.

The pick-up head 240 has a housing 241 having a front wall 244, a back wall 246, and a top surface 248. Preferably, the back wall 246 is sloped inwardly and rearwardly to the debris outlet 242, to thereby deflect debris 204 on the surface being cleaned 202 to the debris outlet 242 as the utility type surface cleaning vehicle 200 travels forwardy, as indicated by arrow "B". Further, the housing 241 has a wide front portion 240*w* and a narrow rear portion 240*n*, with the debris outlet 242 in the narrow rear portion 240*n*. The narrow rear portion 240*n* extends rearwardly from the wide front portion 240*w* of the pick-up head 240 beneath the rear axle assembly 217 of the unitary frame utility type tractor 210. Preferably, the narrow rear portion 240*n* is substantially rigid, made from a suitable metal material, or any other suitable material.

The narrow rear portion 240*n* is mounted on the unitary frame utility type tractor 210 in vertically free-moving relation so as to accommodate vertical variations in a surface being cleaned 202. Further, the wide front portion 240*w* of the pick-up head 240 and the narrow rear portion 240*n* are connected together one to the other in vertically offsetable relation. In other words, one or both of the wide front portion 240*w* and the narrow rear portion 240*n* can be moved vertically with respect to the other in order to adjust the effective cross-sectional area with respect to the surface being cleaned. A suitably flexibly connecting member, or the like, which is not specifically shown, can be used to span between the wide front portion 240*w* and the narrow rear portion 240*n* in sealed relation one to the other such that a flow of air does not pass between the wide front portion 240*w* and the narrow rear portion 240*n*.

The narrow rear portion 240*n* has a maximum width "W" and a maximum height "H". Preferably, the maximum width "W" is substantially greater than the maximum height "H". Even more preferably, the ratio of the maximum width "W" to the maximum height "H" is at least 10:1, and the narrow rear portion 240*n* is substantially rectangular in cross-section.

As can be readily seen in FIG. 6, the narrow rear portion 240*n* has an opening 243 along its bottom area to thereby be open to a surface being cleaned. The opening 243 is a very significant aspect of the present invention. In the prior art, large debris, such as small branches or the like, would become lodged in a prior art duct that is closed around its entire periphery. With the present invention, any large debris that might otherwise become lodged in a prior art duct that is closed around its entire periphery, would not become stuck in the open-bottom narrow rear portion 240*n*. Large debris, such as small branches or the like, are merely "ridden over" by the open-bottom narrow rear portion 240*n*, thereby precluding debris from becoming stuck.

An air and debris transfer duct 250 has an inlet 252 connected in debris receiving relation to the debris outlet 242 of the pick-up head 240 and also has the debris outlet 252 that is connected in debris depositing relation to the inlet 232 of the debris hopper 230. In the second embodiment, as illustrated, the air and debris transfer duct 250 is generally straight to preclude debris from becoming lodged therein.

The pick-up head 240 extends laterally between a first side edge 241*a* and a second side edge 241*b*. The first side edge 241*a* and the second side edge 241*b* are disposed forwardly of the first and second rear wheels 216 of the tractor 210. Further, the first side edge 241*a* of the pick-up head 240 is disposed laterally outwardly beyond the inner edge of the first rear wheel and the second side edge 241*b* of the pick-up head is disposed laterally outwardly beyond the inner edge of the second rear wheel.

The wide front portion of the pick-up head includes front side walls that are connected to an upper pick-up head portion for movement between a lowered in-use position and a raised position. The narrow rear portion includes rear side walls that are connected to an upper pick-up head portion for movement between a lowered in-use position and a raised position. The front side walls and the rear side walls are connected to the upper pick-up head portion by hinges 243*h*. There are also hinge covers 243*hc* to secured over the hinges 243*h*.

Figure 7:
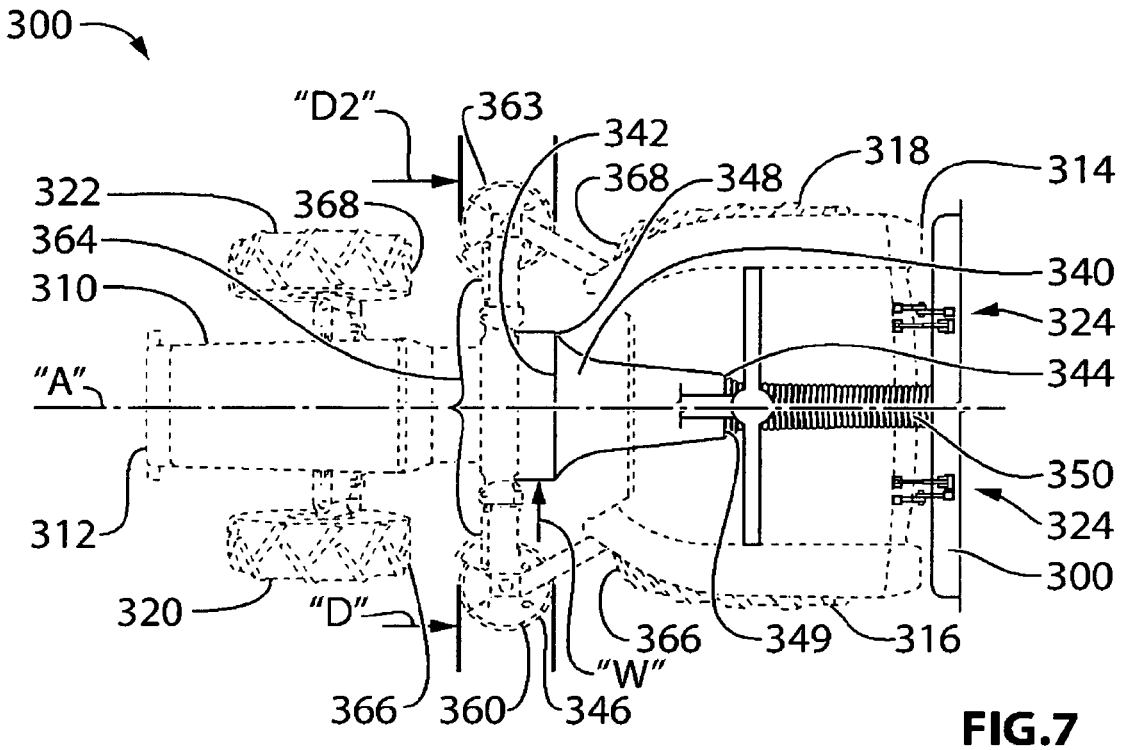
FIG. 7 is a top plan view with a portion of the tractor omitted for the sake of clarity of the third embodiment of the utility type surface cleaning vehicle according to the present invention; and, FIG. 8 is a top plan view with a portion of the tractor omitted for the sake of clarity of the fourth embodiment of the utility type surface cleaning vehicle according to the present invention.

Reference will now be made to FIG. 7, which shows a third embodiment of the utility type surface cleaning vehicle of the present invention, as indicated by general reference numeral 300. The utility type surface cleaning vehicle 300 comprises a unitary frame utility type tractor 310 defining a longitudinal axis "A" and having a front end 312 and a back end 314, a first rear wheel 316 and a second rear wheel 318, and at least one steerable front wheel, specifically a first steerable front wheel 320 and a second steerable front wheel 322, and a trailing unit connecting mechanism 324.

A debris hopper 330 is removably connectable in trailing relation to the utility type tractor 310 via the trailing unit connecting mechanism 324.

A pick-up head 340 extends between a front end 342 and back end 344, and adjacent the front end 342 extends between a first side 346 and a second side 348. The pick-up head 340 also has a debris outlet 349. The pick-up head 340 is operatively mountable on the unitary frame utility type tractor 310 between the first rear wheel 316 and the second rear wheel 318 and such that the front end 342 of the pick-up head 340 is disposed forwardly of the front of the each of first rear wheel 316 and the second rear wheel 318, and such that the first side edge 346 of the pick-up head 340 is disposed laterally outwardly beyond the inner edge 316*a* of the first rear wheel 316 and the second side edge 348 of the pick-up head 340 is disposed laterally outwardly beyond the inner edge 318*a* of the second rear wheel 318.

An air and debris transfer duct 350 is connected to the debris outlet 349 and extends under the rear axle assembly 317 of the unitary frame utility type tractor 310.

A first gutter broom 360 is disposed immediately forwardly of the first rear wheel 316 and a second gutter broom 362 is disposed immediately forwardly of the second rear wheel 318. The first gutter broom 360 and the second gutter broom 362 are substantially adjacent each other with a lateral gap 364 therebetween. The lateral gap is smaller than the width "W" of the front end 342 of the pick-up head 340.

A longitudinal gap 366 is at the bottom of the unitary frame utility type tractor 310 and has a length defined between the first front wheel 320 and the first rear wheel 316. The first gutter broom 360 has an overall diameter "D1" and is disposed at least partially between the first front wheel 320 and the first rear wheel 316. The overall diameter "D1" of the first gutter broom 360 is at least eighty percent of the longitudinal gap 366.

Similarly, a longitudinal gap 368 is at the bottom of the unitary frame utility type tractor 310 and has a length defined between the second front wheel 322 and the second rear wheel 318. The second gutter broom 362 has an overall diameter "D2" and is disposed at least partially between the second front wheel 320 and the second rear wheel 318. The overall diameter "D2" of the second gutter broom 362 is at least eighty percent of the longitudinal gap 368.

Figure 8:
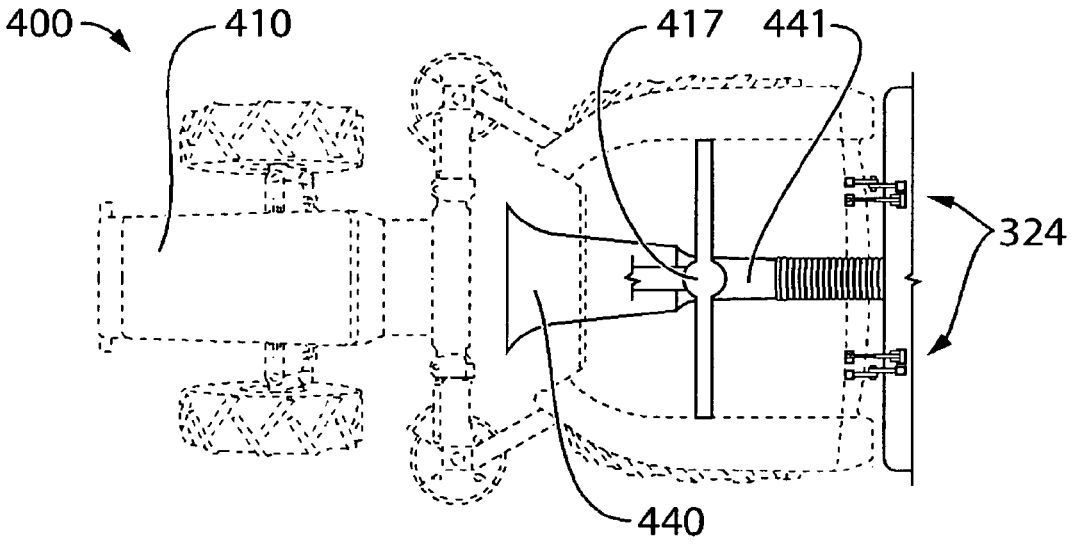

Reference will now be made to FIG. 8, which shows a fourth embodiment of the utility type surface cleaning vehicle of the present invention, as indicated by general reference numeral 400. The utility type surface cleaning vehicle 400 is similar to the third embodiment utility type surface cleaning vehicle 300 except that the rear portion 441 of the pick-up head 440 extends under the rear axle assembly 417 of the unitary frame utility type tractor 410.

As can be understood from the above description and from the accompanying drawings, the present invention provides a utility type surface cleaning vehicles that use conventional unitary frame utility type tractors for motive power, wherein does not readily clog the duct that connects the pick-up head to the debris hopper, which features are unknown in the prior art.

Other variations of the above principles will be apparent to those who are knowledgeable in the field of the invention, and such variations are considered to be within the scope of the present invention. Further, other modifications and alterations may be used in the design and manufacture of the present invention without departing from the spirit and scope of the accompanying claims.

I claim:

1. A utility type surface cleaning vehicle comprising:

a unitary frame utility type tractor defining a longitudinal axis and having a front end and a back end, left and right driven rear wheels and at least one steerable front wheel and a trailing unit connecting mechanism;

a debris hopper removably connectable in trailing relation to said utility type tractor via said trailing unit connecting mechanism;

a pick-up head operatively mountable on said unitary frame utility type tractor, wherein said pick-up head has a housing having a wide front portion and a narrow rear portion, and a debris outlet in the narrow rear portion;

wherein said narrow rear portion of said housing of said pick-up head extends rearwardly beneath the rear axle assembly of said unitary frame utility type tractor; and, an air and debris transfer duct having an inlet connected in debris receiving relation to said debris outlet of said pick-up head and an outlet connected in debris depositing relation to said debris hopper.

2. The utility type surface cleaning vehicle of claim 1, wherein said pick-up head is selectively raisable and lowerable between a lower surface-engaging position and a raised damage-precluding position.

3. The utility type surface cleaning vehicle of claim 1, wherein said narrow rear portion of said housing of said pick-up head is substantially rigid.

4. The utility type surface cleaning vehicle of claim 1, wherein said narrow rear portion of said housing of said pick-up head has a maximum width and a maximum height, and wherein the maximum width is substantially greater than the maximum height.

5. The utility type surface cleaning vehicle of claim 4, wherein the ratio of the width to the height of said narrow rear portion of said housing of said pick-up head is at least 10:1.

6. The utility type surface cleaning vehicle of claim 4, wherein said narrow rear portion of said housing of said pick-up head is substantially rectangular in cross-section.

7. The utility type surface cleaning vehicle of claim 1, wherein said pick-up head comprises a recirculating air type pick-up head.

8. The utility type surface cleaning vehicle of claim 1, wherein said pick-up head comprises a suctioning type pick-up head.

9. The utility type surface cleaning vehicle of claim 1, further comprising at least one gutter broom mounted on said utility type tractor forwardly of the pick-up head and rearwardly of the at least one steerable front wheel.

10. The utility type surface cleaning vehicle of claim 1, wherein said pick-up head is operatively mountable on said unitary frame utility type tractor forwardly of said rear wheels.

11. The utility type surface cleaning vehicle of claim 1, wherein said air and debris transfer duct is generally straight.

12. The utility type surface cleaning vehicle of claim 1, wherein said wide front portion and said narrow rear portion are connected together one to the other in vertically offsetable relation.

13. The utility type surface cleaning vehicle of claim 1, wherein said pick-up head is mounted on said tractor in vertically free-moving relation so as to accommodate vertical variations in a surface being cleaned.

14. The utility type surface cleaning vehicle of claim 1, wherein said wide front portion of said housing of said pick-up head is mounted on said tractor in vertically free-moving relation so as to accommodate vertical variations in a surface being cleaned.

15. The utility type surface cleaning vehicle of claim 1, wherein said narrow rear portion of said housing of said pick-up head is mounted on said tractor in vertically free-moving relation so as to accommodate vertical variations in a surface being cleaned.

16. The utility type surface cleaning vehicle of claim 1, wherein said wide front portion of said housing of said pick-up head has a back wall that is sloped inwardly and rearwardly to said debris outlet, to thereby deflect debris to said debris outlet as said utility type surface cleaning vehicle travels forwardy.

17. The utility type surface cleaning vehicle of claim 1, further comprising a bottom opening in said air and debris transfer duct which is generally defined along its lateral perimeter by a first bottom edge and a second bottom edge.

18. The utility type surface cleaning vehicle of claim 17, further comprising at least one sealing member disposed along said first and second bottom edges, such that in use, said at least one sealing member is disposed.

19. The utility type surface cleaning vehicle of claim 1, wherein said pick-up head extends laterally between a first side edge and a second side edge, and the first side edge and the second side edge are disposed forwardly of the first and second rear wheels of the tractor.

20. The utility type surface cleaning vehicle of claim 1, wherein has a first side edge and a second side edge, said first side edge said pick-up head is disposed laterally outwardly beyond the inner edge of said first rear wheel and said second side edge of said pick-up head is disposed laterally outwardly beyond the inner edge of said second rear wheels.

21. The utility type surface cleaning vehicle of claim 1, wherein said wide front portion of said pick-up head includes front side walls that are connected to an upper pick-up head portion for movement between a lowered in-use position and a raised position.

22. The utility type surface cleaning vehicle of claim 21, wherein said front side walls are connected to said upper pick-up head portion by hinges.

23. The utility type surface cleaning vehicle of claim 22, further comprising hinge covers secured over said hinges.

24. The utility type surface cleaning vehicle of claim 1, wherein said narrow rear portion includes rear side walls that are connected to an upper pick-up head portion for movement between a lowered in-use position and a raised position.

25. The utility type surface cleaning vehicle of claim 24, wherein said rear side walls are connected to said upper pick-up head portion by hinges.

26. The utility type surface cleaning vehicle of claim 25, further comprising hinge covers secured over said hinges.

27. A debris removal and transfer apparatus for use mounted on a unitary frame utility type tractor defining a longitudinal axis and having a front end and a back end, left and right driven rear wheels and at least one steerable front wheel and a trailing unit connecting mechanism, said debris removal and transfer apparatus comprising:

a debris hopper removably connectable in trailing relation to the utility type tractor via the trailing unit connecting mechanism;

a pick-up head operatively mountable on said unitary frame utility type tractor, wherein said pick-up head has a housing having a wide front portion and a narrow rear portion, and a debris outlet in the narrow rear portion;

wherein said narrow rear portion of said housing of said pick-up head extends rearwardly beneath the rear axle assembly of said unitary frame utility type tractor; and, an air and debris transfer duct having an inlet connected in debris receiving relation to said debris outlet of said pick-up head and an outlet connected in debris depositing relation to said debris hopper.

28. A debris removal and transfer system for use mounted on a unitary frame utility type tractor defining a longitudinal axis and having a front end and a back end, left and right driven rear wheels and at least one steerable front wheel and a trailing unit connecting mechanism, said debris removal and transfer apparatus comprising:

a debris hopper removably connectable in trailing relation to the utility type tractor via the trailing unit connecting mechanism;

a pick-up head operatively mountable on said unitary frame utility type tractor, wherein said pick-up head has a housing having a wide front portion and a narrow rear portion, and a debris outlet in the narrow rear portion;

wherein said narrow rear portion of said housing of said pick-up head extends rearwardly beneath the rear axle assembly of said unitary frame utility type tractor; and, an air and debris transfer duct having an inlet connected in debris receiving relation to said debris outlet of said pick-up head and an outlet connected in debris depositing relation to said debris hopper.

* * * * *